United States Patent [19]

Kawada

[11] 4,162,675

[45] Jul. 31, 1979

[54] WHOLE BODY SPECIFIED AREA STIMULATING THERAPY DEVICE

[76] Inventor: Sooji Kawada, No. 49-6, 5-Chome, Nakano, Nakano-ku, Tokyo, Japan

[21] Appl. No.: 833,754

[22] Filed: Sep. 15, 1977

[30] Foreign Application Priority Data

Oct. 4, 1976 [JP] Japan ..... 51-119145

[51] Int. Cl.[2] ..... A61H 23/00

[52] U.S. Cl. ..... 128/55; 128/52; 128/56

[58] Field of Search ..... 128/55, 56, 38–40, 128/24.1, 24.2, 51, 52

[56] References Cited

U.S. PATENT DOCUMENTS

| | | | |
|---|---|---|---|
| 3,797,481 | 3/1974 | Doran | 128/56 |
| 3,818,904 | 6/1974 | kawada | 128/56 |
| 3,978,851 | 9/1976 | Sobel | 128/56 |
| 4,088,128 | 5/1978 | Mabuchi | 128/55 |

FOREIGN PATENT DOCUMENTS

| | | | |
|---|---|---|---|
| 573936 | 3/1958 | Italy | 128/56 |

*Primary Examiner*—Lawrence W. Trapp
*Attorney, Agent, or Firm*—Holman & Stern

[57] ABSTRACT

A body specified area stimulating device wherein a large number of thin bars having elasticity are fixed on an operating shaft. Beating members are fitted to the tips of the thin bars. The shaft is coupled to a power drive unit formed by a motor and the beating members are rotated to beat the body below the head to stimulate a large number of specified areas existing in the body. Also a head specified area stimulating device is disclosed wherein specified area beating members having elasticity are provided in front portion of a rod for converting the rotating motion of the motor to reciprocating motion of right and left directions. The rod is coupled to the power drive unit and the beating members are caused to appear frequently from the case to stimulate the specified areas of the head. The body specified area stimulating device and the head specified area stimulating device are interchangeably mounted on the power drive unit so that the specified areas of the whole body can be stimulated and the desired therapy can be obtained.

4 Claims, 8 Drawing Figures

WHOLE BODY SPECIFIED AREA STIMULATING THERAPY DEVICE

BACKGROUND OF INVENTION

The present invention relates to a therapy device, and more particularly to a therapy device for stimulating specified areas of the whole body to apply therapy by stimulating specified areas of the body with use of a body specified area stimulating device and a head specified area stimulating device which are interchangeably mounted on a power drive unit formed by motor according to the areas of the body to be treated.

Heretofore, as physical therapy not using medicines, finger-pressure therapy and acupuncture therapy have been performed. These therapies are inconvenient as they must be performed by experts, and there is a drawback that complete effect of the therapy cannot be obtained by the therapy performed by oneself or a near relative.

The present invention has succeeded in solving the conventional problems almost completely.

OBJECTS OF THE INVENTION

An object of the present invention is to provide a therapy device for stimulating specified areas of the whole body which is simple in structure, low in cost and yet easy to operate.

Another object of the present invention is to provide a therapy device provided with a body specified area stimulating device for applying stimulation to specified areas of the body below the head to promote blood flow or to activate the lymphatic glands and nervous system.

A further object of the present invention is to provide a therapy device provided with a head specified area stimulating device for applying a specified area stimulating effect to the head.

A yet further object of the present invention is to provide a therapy device provided with either the body specified area stimulating device or the head specified area stimulating device which are interchangeable according to the areas of the whole body to be treated.

Other objects and advantages of the invention will become apparent from the following detailed description of an embodiment of the invention when considered together with the attached drawings.

DETAILED DESCRIPTION OF INVENTION

Figure 1:
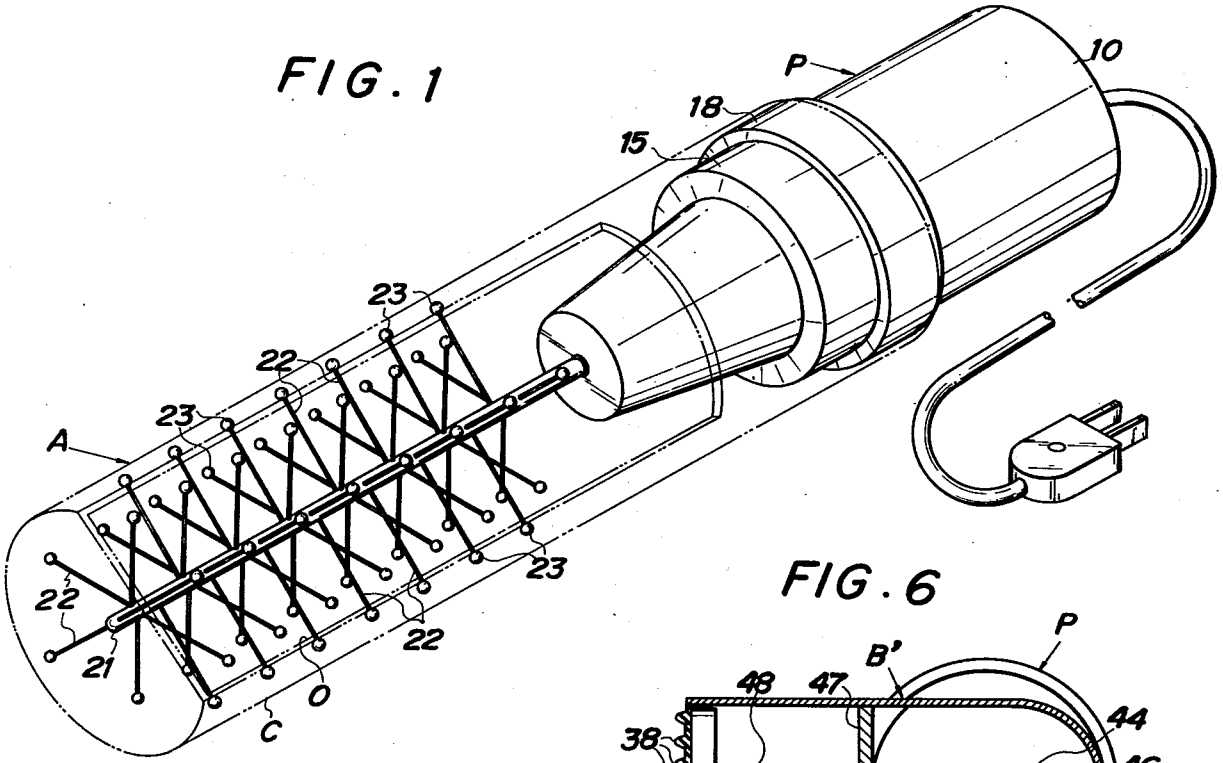
FIG. 1 is a perspective view showing a body specified area stimulating device mounted on a power drive unit according to the present invention.

The whole body specified area stimulating therapy device according to the present invention comprises a power drive unit shown generally by letter P, a body specified area stimulating device A for applying stimulation to specified areas of the body by beating the body below the head, and a head specified area stimulating device B for applying stimulation to specified areas of the head by applying pressure to spectified areas of the head. The body specified area stimulating device A and the head specified area stimulating device B are interchangeably mounted on the power drive unit according to the areas of the body to be treated.

The power drive unit P is constructed in such a way that a motor 11 is installed in a motor case 10, and a shaft 12 of the motor 11 extends upwardly. The tip of the shaft 12 is formed with a polygonal portion 13. On the upper periphery of the motor case 10, a male thread 14 is formed.

The body specified area stimulating device A is provided on the upper part of a case 15 which is fitted on the upper part of the motor case 10 of the power drive unit P. On an annular projection 16 provided on the lower end of the case 15, a connecting ring 18 is provided with a female thread 17 on its inner peripheral surface which matches and can mate with the male thread 14 of the motor case 10. Thus, the motor case 10 and the case 15 can be coupled and fixed by turning the connecting ring 18 after screwing the thread 14 and the thread 17. An operating shaft 21 extends through the upper part of the outside of the case 15 through a support plate 19 and an upper plate 20. A plurality of thin bars 22 having elasticity are fixed onto shaft 21. Beating members 23 in ball shape and the like are mounted on the tips of the thin bars 22.

A connecting member 24 in the form of a socket fitting the polygonal portion 13 of the tip of the shaft 12 of the motor 11 for operatively connecting the operating shaft 21 and the shaft 12 is fixed at the lower end of the operating shaft 21. The connecting member 24 fits the polygonal portion 13 of the tip of the shaft 12 to connect the operating shaft 21 and the shaft 12 to enable rotation of the operating shaft 21 by the rotation of the motor 11.

Figure 3:
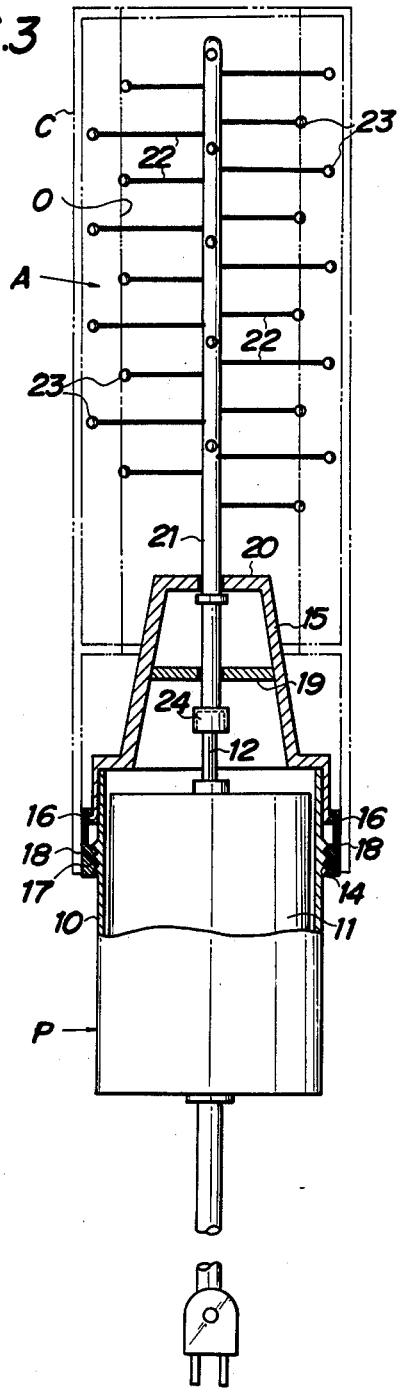
FIG. 3 is a partial cross-sectional view and elevation showing the body specified area stimulating device mounted on the power drive Unit.
Figure 4:
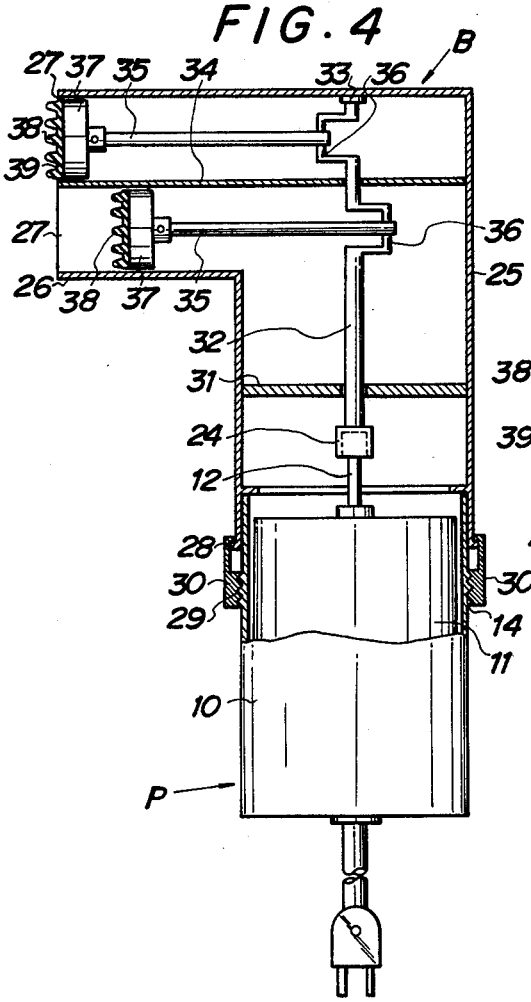
FIG. 4 is a partial cross-sectional view and elevation of the head specified area stimulating device mounted on the power drive unit.

In the body specified area stimulating device A, the motor case 10 of the power drive unit P and the case 15 are connected by the connecting ring 18. The shaft 12 and the operating shaft 21 are connected by the connecting member 24. The motor 11 is rotated by passing an electric current to the motor 11. The operating shaft 21 rotates together with the shaft 12, thus the beating members 23 are rotated as the operating shaft 21 rotates. In this condition, the beating members 23 can contact the body below the head to effect beating; the beating members 23 stimulate elastically a large number of specified areas existing in the body. However, in the case when this body specified area stimulating device A is used for stimulating the specified areas of the head, the thin bars become entangled with the hair. Thus the body specified area stimulating device A cannot be used for stimulating the head. But in the case when the body specified area stimulating device A is used for treating the borders of the hair such as the neck portion, it is suggested that the stimulating device A be covered wth with a transparent cover C having an opening portion O as shown in imaginary line in FIG. 1 and FIG. 3 on its case 15 in such a manner that the cover C covers the beating members 23, so that the treatment can be applied only from the opening portion O to prevent entanglement of the hair with the beating members 23.

The head specified area stimulating device B is mounted in the case 25 which is fitted and fixed to he upper part of the motor case 10 provided with the power drive unit P. This case 25 is provided with a projecting portion 26 at the upper part. An opening portion 27 is provided at the tip of the projecting portion 26. An annular projection 28 provided at the lower end of the case 25 carries a connecting ring 30. The connecting ring 30 is provided on its inner peripheral surface with a female thread 29 which matches and can mate with the male thread 14 of the motor case 10. Thus, the motor case 10 and the case 25 can be connected and fixed by turning the connecting ring 30 after screwing the thread 14 and the thread 29. The connecting member 24 is fixed to the lower end portion of a crank shaft 32 extending upwardly through a support plate 31 from the lower part of the inside of the case 25. The connecting member 24 fits to the polygonal portion 13 of the tip of the shaft 12 of the motor 11. Thus, the shaft 12 and the crank shaft 32 are connected.

The crank shaft 32 is further extended, and its upper end is pivotally supported by a bearing 33. The rear end portions of rods 35 extending to the opening portion 27 are connected to crank pins 36 on shaft 32 with a sectioned wall 34 as a border. Plates 37 are fixed to the tips of the rods 35. Specified area stimulating members 39 having elasticity are provided with a large number of projections 38 fixed on the surfaces of the plates 37.

The head specified area stimulating device B can apply stimulation to specified areas of the head when the motor case 10 of the power drive unit P and the case 25 are connected by the connecting ring 18, the shaft 12 and the crank shaft 32 are connected by the connecting member 24, and the motor 11 is rotated by passing an electric current therethrough. The rotating motion of the shaft 12 is converted to reciprocating motion in right and left directions of the rods 35 by the rotation of the crank shaft 32 through crank pins 36. The specified area stimulating members 39 provided on the plates 37 at the tips of the rods 35 repeat piston like motions through opening portion 27 continuously so that the specified areas of the head are stimulated by the projections 38.

Figure 6:
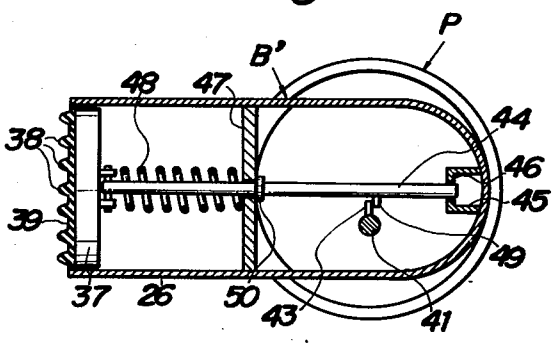
FIG. 6 is a lateral cross sectional view of the elevation of FIG. 5.
Figure 2:
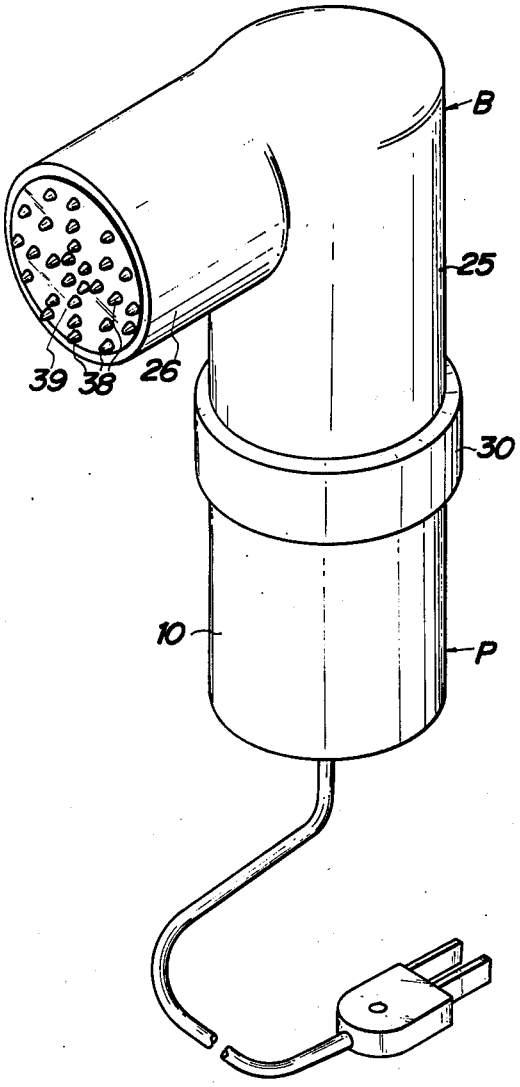
FIG. 2 is a perspective view showing a head specified area stimulating device mounted on the power drive unit.
Figure 5:
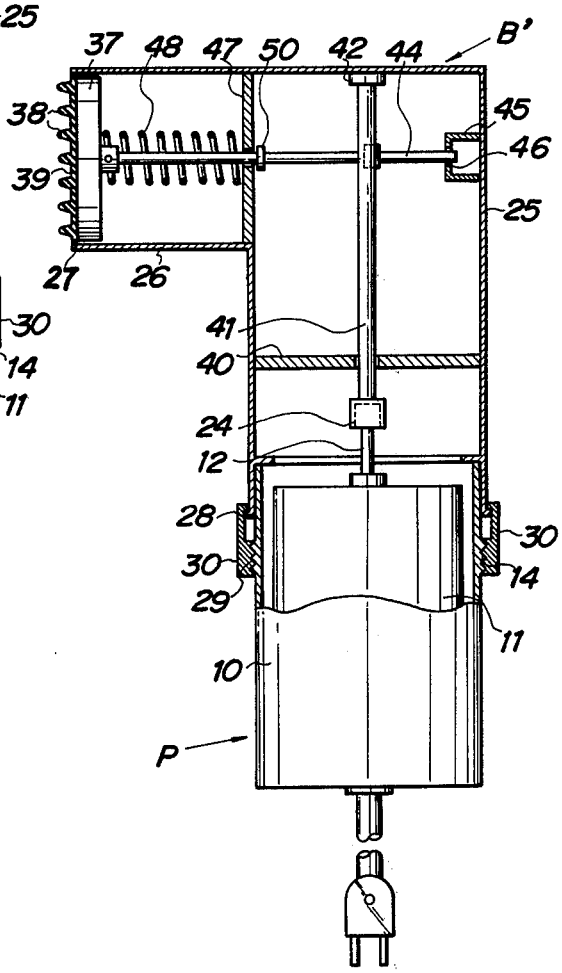
FIG. 5 is a partial cross-sectional view and elevation of another embodiment of a head specified area stimulating device mounted on the power drive unit.

FIG. 5 and FIG. 6 show another embodiment of the head specified area stimulating device. This head specified area stimulating device B' is constructed in such a way that the connecting member 24 is fixed to a lower end portion of an interlocking shaft 41 extending upwardly through a support plate 40 from the lower part of the inside of a case 25. The connecting member 24 fits the polygonal portion 13 of the tip of a shaft 12 of a motor 11 to connect the shaft 12 and the interlocking shaft 41. The interlocking shaft 41 is extended upward and is pivotally supported at its upper end by means of a bearing 42. A projecting member 43 is provided on the upper part of the interlocking shaft 41. A rear end portion of a rod 44 is inserted into a hole 46 of a holding plate 45 provided in the case 25 so as to be able to move laterally. The tip portion of the rod 44 is extended to the opening portion 27 side through a wall 47. A plate 37 is fixed to the tip of the rod 44, and a specified area stimulating member 39 having elasticity and being provided with a large number of projections 38 is fixed on the surface of the plate 37. A coil spring 48 is mounted on the rod 44 between the wall 47 and the plate 37. A pawl member 49 on rod 44 engages the projecting member 43. A stopper 50 for stopping the advancement of the rod 44 to prevent the specified area stimulating member 39 from projecting too much from the opening portion 27 is provided on the rod 44.

In the head specified area stimulating device B' similar to the head specified area stimulating device B, the motor case 10 of the power drive unit P and the case 25 are connected by the connecting ring 30 and the shaft 12 and the interlocking shaft 41 are connected by the connecting member 24. The motor 11 is rotated by passing an electric current therethrough to rotate the interlocking shaft 41. The projecting member 43 is engaged with the pawl member 49 of the rod 44 compressing the coil spring 48 to shift the rod 44 to the side of the rear end. The interlocking shaft 41 rotates releasing the engaging condition of the pawl member 49 with the projecting member 43 so that the coil spring 48 elastically expands to shift the rod 44 to the opening portion 27 side. The stopper 50 stops the rod movement by being urged against the wall 47. The rod 44 repeats the reciprocating motion by the rotating motion of the motor 11, and the specified area stimulating member 39 appears frequently from the opening portion 27 to stimulate the specified areas of the head by the projections 38.

Figure 7:
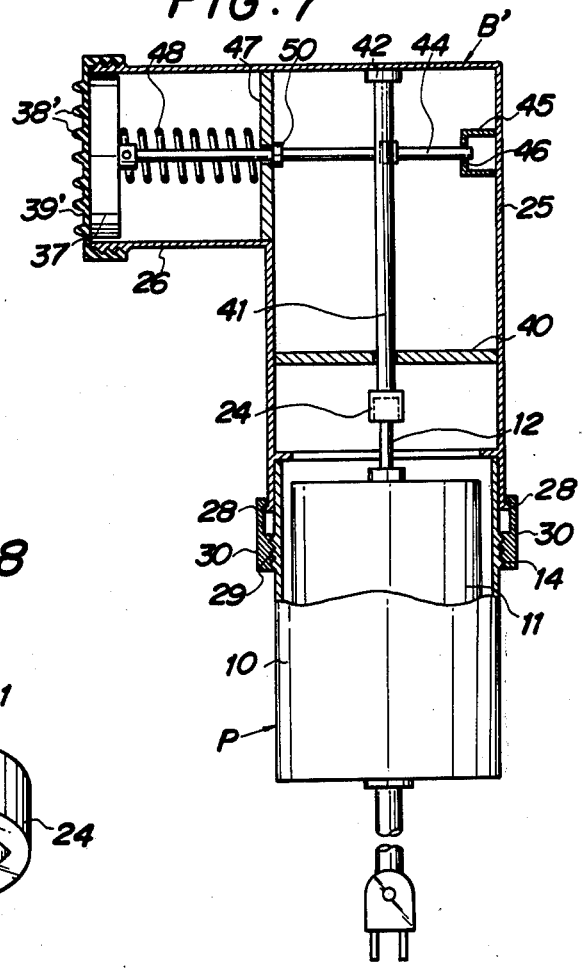
FIG. 7 is a partial cross-sectional view and elevation of a further embodiment of a head specified area stimulating device mounted on the power drive unit.
Figure 8:
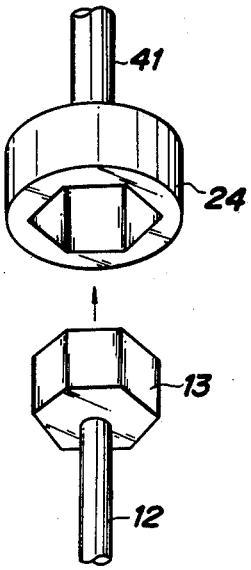
FIG. 8 is a perspective view showing relationship between the shaft of the motor and the connecting member.

FIG. 7 shows still another embodiment wherein instead of fixing the specified area stimulating member 39 on the plate 37 of the head specified area stimulating device B', a specified area stimulating member 39' having elasticity and being provided with a large number of projections 38' is mounted on an outer peripheral edge of the opening portion 27 of the case 25 as a cover. The bottom portion of the specified area stimulating member 39' is intermittently pressed by means of the plate 37 to use the device.

Accordingly, the present invention is constructed in such a way that the power drive unit P and the body specified area stimulating device A are connected by means of the connecting ring 18 and the connecting member 24, and the power of the power drive unit P is transmitted to the body specified area stimulating device A to rotate the operating shaft 21 and at the same time the beating members 23. The beating members 23 are caused to contact the body below the head to accomplish beating. Since beating members 23 are fixed to the tips of the thin bars 22 having elasticity, the specified areas existing in the body is elastically stimulated by the beating members 23. Thus blood flow, the lymphatic gland and the nervous system are promoted and at the same time the skin can be exercised.

Furthermore, in order to apply specified area stimulating effect to the head with the use of the power drive unit P, the body specified area stimulating device A is removed from the power drive unit P, and the power drive unit P and the head specified area stimulating device B are connected by means of the connecting ring 30 and the connecting member 24. The power of the power drive unit P is transmitted to the head specified stimulating device B to convert the rotating motion of the motor 11 to the reciprocating motion in right and left directions of the rods 35. The projections 38 of the specified area stimulating member 39 fixed to the plates 37 of the tips of the rods 35 are urged against the specified areas of the head and the projections 38 apply the pressure to the specified areas of the head intermittently so that the specified area stimulating effect can be rendered to the head. Namely, by interchangeably using the body specified area stimulating device A and the head specified area stimulating device B, the specified areas of the whole body can be stimulated to obtain a therapy effect.

Many modifications may be made by those who desire to practice the invention without departing from the scope thereof which is defined by the appended claims.

What is claimed is:

1. A whole body specified area stimulating therapy device comprising a power drive unit, a body specified area stimulating device, and a head specified area stimulating device; said power drive unit is formed by mounting a motor in a motor case, a shaft of the motor is extended upward to provide a polygonal portion at the tip thereof, and a male thread is formed on the outer periphery of the upper part of the motor case; the body specified area stimulating device is provided on the upper part of a case which is fitted and fixed to the upper part of the motor case, the case is connected to the motor case by a connecting ring provided with a female thread screwing with the male thread of the motor case, a large number of thin bars having elasticity are fixed to an operating shaft which is extended upward of the outside of the case from the inside of the case, beating members like balls are mounted on the tips of the thin bars, a transparent cover having an opening portion can be mounted on a case surrounding according to necessity in such a way that it covers the beating members, and the connecting member fixed to the lower end of the operating shaft is fitted to the polygonal portion of the shaft of the motor so as to connect the shaft of the motor and the operating shaft; the head specified area stimulating device is provided in a case which is fitted and fixed to the upper part of the motor case, the case is provided with a projecting portion having an opening portion at its tip, the case is connected to the motor case by the connecting ring having female thread screwing the male thread formed on the motor case, is interlocked with the shaft of the motor by the connecting member and a specified area stimulating member having elasticity provided with a large number of projections is provided at a tip portion of a rod means for converting the rotating motion of the motor to the reciprocating motion in right and left directions; the body specified area stimulating device and the head specified area stimulating device are interchangeably mounted on the power drive unit to be used for therapy.

2. The whole body specified area stimulating therapy device as claimed in claim 1 wherein the head specified area stimulating device is provided in the case which is fitted and fixed to the upper part of the motor case, an upper end of a crank shaft extended upward through a support plate from the lower part of the inside of the case is pivotally supported by a bearing, the connecting member is fixed to the polygonal portion of the tip of the shaft of the motor to connect the shaft of the motor to the crank shaft, rear end portions of the rods extended to the opening portion of the case are connected to a crank pins, plates are fixed to the tips of the rods, and the specified area stimulating member having elasticity provided with a large number of projections is fixed on the surface of the plates 3. The whole body specified area stimulating therapy device as claimed in claim 1 wherein the head specified area stimulating device is provided in the case which is fitted and fixed to the upper part of the motor case, an upper end of the interlocking shaft extended upward through the support plate from the lower part of the inside of the case is pivotally suppoted by a bearing, the connecting member is fixed to the lower end of the interlocking shaft, the connecting member is fitted to the polygonal portion of the tip of the shaft of the motor to connect the shaft of the motor to the interlocking shaft, projecting members are provided on the upper part of the interlocking shaft, a rear end portion of the rod is inserted into the hole of the holding plate provided in the case so as to move laterally, the tip portion of the rod is extended to the opening portion side through the wall, the plate is fixed to the tip of the rod, the specified area stimulating member having elasticity provided with a large bumber of projections is fixed on the surface of the plate, a coil spring is provided on the outer periphery of the rod between the wall and the plate, and a pawl member engaging the projecting member and a stopper for blocking the advancement of the rod within a fixed value are provided on the rod.

4. The whole body specified area stimulating therapy device as claimed in claim 3 wherein the specified area stimulating member having elasticity provided with a large number of projections of the head specified area stimulating device is mounted on the outer peripheral edge of the opening portion of the case as a cover.

* * * * *